US009697979B2

(12) United States Patent
Champeaux et al.

(10) Patent No.: US 9,697,979 B2
(45) Date of Patent: Jul. 4, 2017

(54) MICROWAVE WAVE GENERATOR DEVICE WITH A VIRTUAL CATHODE OSCILLATOR AND AXIAL GEOMETRY, COMPRISING AT LEAST ONE REFLECTOR AND A MAGNETIC RING, CONFIGURED TO BE SUPPLIED BY A HIGH-IMPEDANCE GENERATOR

(71) Applicant: Commissariat A L'Energie Atomique et Aux Energies Alternatives, Paris (FR)

(72) Inventors: Stephanie Champeaux, Breuillet (FR); Philippe Gouard, Yeares (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 15/106,982

(22) PCT Filed: Dec. 19, 2014

(86) PCT No.: PCT/FR2014/053471

§ 371 (c)(1),
(2) Date: Jun. 21, 2016

(87) PCT Pub. No.: WO2015/097384

PCT Pub. Date: Jul. 2, 2015

(65) Prior Publication Data

US 2017/0032922 A1 Feb. 2, 2017

(30) Foreign Application Priority Data

Dec. 23, 2013 (FR) ..... 13 63456

(51) Int. Cl.
*H01J 7/46* (2006.01)
*H01J 25/32* (2006.01)
*H01J 25/74* (2006.01)

(52) U.S. Cl.
CPC ..... *H01J 25/32* (2013.01); *H01J 25/74* (2013.01)

(58) Field of Classification Search
CPC ..... H01J 37/32201; H01J 37/32311
(Continued)

(56) References Cited

U.S. PATENT DOCUMENTS 3,789,257 A * 1/1974 Friedman ..... H01J 25/34 315/3
4,122,372 A * 10/1978 Walsh ..... H01S 1/005 315/5

(Continued)

OTHER PUBLICATIONS

Champeaux et al., "Numerical evaluation of the role of reflectors to maximize the power efficiency of an axial Vircator," 2013 IEEE, 2 pages.

*Primary Examiner* — Thuy Vinh Tran
(74) *Attorney, Agent, or Firm* — Brinks Gilson & Lione

(57) ABSTRACT

A microwave wave generator device with oscillating virtual cathode, with axial geometry, includes at least one first reflector positioned in a cylindrical waveguide downstream of a thin anode, positioned at the entrance of the cylindrical waveguide, between a cathode and the cylindrical waveguide. The device further includes a tight magnetic ring of width ($L_M$) along the longitudinal axis (z), positioned externally around the cylindrical waveguide, between the thin anode and the first reflector.

9 Claims, 4 Drawing Sheets

(58) Field of Classification Search
USPC ..... 315/39; 331/187; 333/242
See application file for complete search history.

(56) References Cited

U.S. PATENT DOCUMENTS

| | | | | | |
|---|---|---|---|---|---|
| 4,298,824 | A * | 11/1981 | Walsh | ..... | H01J 25/34<br>315/3 |
| 4,751,429 | A * | 6/1988 | Minich | ..... | H01J 25/68<br>315/39 |
| 2011/0084606 | A1* | 4/2011 | Olsson | ..... | H01J 25/02<br>315/39.53 |

* cited by examiner

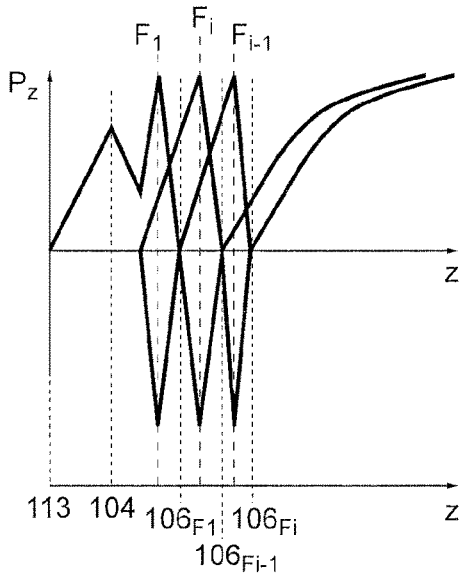
Fig. 10
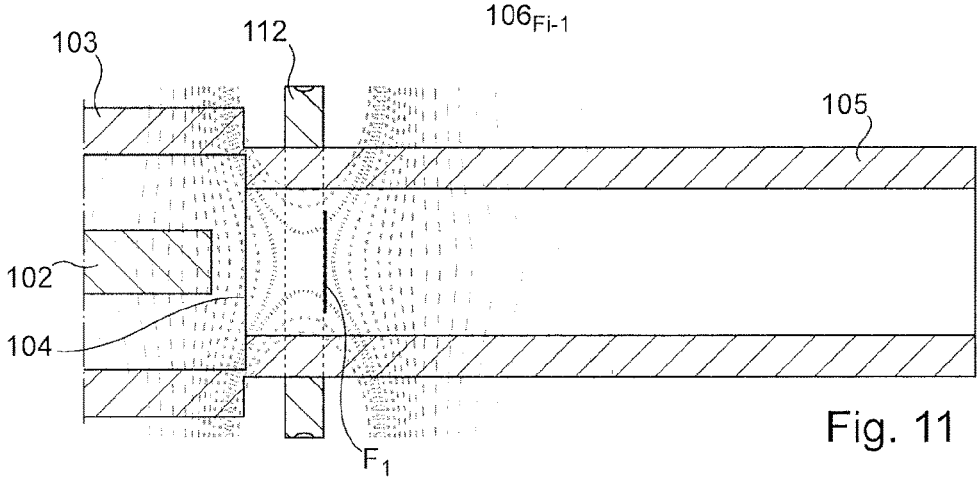
Fig. 11
| Axial VIRCATOR with "open" reflectors and magnetic ring | | | |
|---|---|---|---|
| Number of reflectors | $d_{AF1}$[mm] | $d_{F1F2}$[mm] | $d_{F2F3}$[mm] |
| 1 | 54 | | |
| 2 | 54 | 25 | |
| 3 | 54 | 29 | 25 |
Fig. 12
| Axial VIRCATOR with "open" reflectors and magnetic ring | Frequency (GHz) | Mode | Power (MW) | Efficiency (%) |
|---|---|---|---|---|
| 1 reflector + 1 ring | 2.09 | $TE_{11}$ | 88.05 | 2.5 |
| 2 reflectors + 1 ring | 1.99 | $TE_{11}$ | 301.65 | 8.6 |
| 3 reflectors + 1 ring | 2.33 | $TE_{11}$ | 607.76 | 17.4 |
Fig. 13

MICROWAVE WAVE GENERATOR DEVICE WITH A VIRTUAL CATHODE OSCILLATOR AND AXIAL GEOMETRY, COMPRISING AT LEAST ONE REFLECTOR AND A MAGNETIC RING, CONFIGURED TO BE SUPPLIED BY A HIGH-IMPEDANCE GENERATOR

TECHNICAL FIELD

The present invention concerns a microwave wave generator device with a virtual cathode oscillator (often designated by the appellation of VIRCATOR type, VIRCATOR arising from the expression "VIRtual CAthode oscillaTOR")

A microwave wave generator device with a virtual cathode oscillator of the prior art, or VIRCATOR, is represented diagrammatically in FIG. 1.

BACKGROUND

The VIRCATOR comprises a diode constituted by a cathode 2 and by an anode 3+4, emitting a beam of electrons 1, as well as by a cylindrical wave guide 5. The anode is constituted by a thick frame 3 and by a thin sheet 4 (frequently called "thin anode 4" below by simplification). By "thin" it is meant here that the sheet of the anode 4 has a thickness of the order of the micrometer, that is to say of a few micrometers or even of a few tenths of micrometers. The thin sheet 4 is coupled to the cylindrical wave guide 5. In other words, the thin anode 4 separates the cathode 2 from the cylindrical wave guide 5 by being situated at an entrance to the wave guide 5, at an interface between the thick frame 3 and the wave guide 5; and the thick frame 3 generally surrounds the cathode 2.

This type of device is known to produce high power pulses of microwaves

To that end, a potential difference is applied to the terminals of the diode 2+3+4 creating an electronic emission at the location of the cathode 2. When the density of electron current emitted exceeds the Child-Langmuir current density limit, the electron beam 1 disintegrates under the effect of its own space charge. At the location of the thin sheet 4 of the anode, the components of the electric field that are transverse relative to an axis z representing a longitudinal axis of the wave guide 5, cancel out. The electron beam 1 then begins to be pinched under the effect of its magnetic field. When the current entering the cylindrical wave guide 5 exceeds the space-charge current limit (referred to as "critical" current, denoted $I_c$), the electron density becomes so great that the beam can no longer propagate within the wave guide 5. An accumulation of charge 6, commonly called "virtual cathode 6", then forms beyond the thin sheet 4. The virtual cathode 6 then deviates numerous electrons to the extent of sending some back towards the cathode 2, through the thin sheet 4.

In a relativistic regime, an estimate of the critical current $I_c$ is given by $$I_c = \frac{4\pi\varepsilon_0 mc^3}{q}\frac{(\gamma^{2/3}-1)^{3/2}}{1+2\ln\left(\frac{R_G}{r}\right)}$$

With $\gamma=1+qV/mc^2$, where q is the charge of an electron, V the potential difference applied between the electrodes of the diode 2+3+4, m is the mass of an electron at rest, c is the speed of light and $\epsilon_0$ is the permittivity of a vacuum.

Considering the disintegration of the beam on emission in the diode, the radius of the beam r entering the wave guide is of the order of the radius of the cylindrical wave guide $R_G$. An order of magnitude of the critical current $I_c$ (in kilo-Ampere) is then given by the following simplified expression:

$$I_c \approx 17(\gamma^{2/3}-1)^{3/2}$$

While approaching the thin anode 4, the virtual cathode 6 increases its charge density until the time at which it disintegrates under the effect of its own space charge and a new virtual cathode rebuilds a little further away in the wave guide 5. This is the oscillation principle of the virtual cathode which is at the origin of an emission of a microwave wave 7.

FIG. 1 represents a formation of a virtual cathode oscillator in a VIRCATOR type device of the prior art when the current of the beam exceeds the critical current in the wave guide 5. FIG. 2 represents the characteristic signature, referred to as "diamond-shaped" of the virtual cathode oscillator 6 in the phase space with the acceleration and the deceleration of the electrons on passing the thin anode 4 on their path from the cathode 2 towards the virtual cathode 6 and vice-versa, that is to say the quantity of motion in the longitudinal direction and as a function of the longitudinal position.

The virtual cathode 6 moves around an average position which is situated at a distance from the thin anode 4 approximately equal to that separating the thin anode 4 from the emitter cathode (the latter distance being designated by $d_{Ak}$). The electrons which are sent back by the virtual cathode 6 towards the cathode 2 passing through the thin anode 4 are modulated to the frequency of the microwave wave 7 and interact with the electron beam 1 created in the space between the cathode 2 and the thin anode 4 while modulating it slightly. These backscattered electrons are braked between the thin anode 4 and the cathode 2. They are also mainly deviated towards the frame of the anode 3.

In parallel, the electrons which cross the virtual cathode 6 take back energy from the microwave wave 7 which propagates in the wave guide, so reducing its intensity.

The dimensioning of an axial VIRCATOR according to the known state of the art is the following:

The frequency f of the emitted wave 7 (expressed in GHz) is a function of the distance $d_{Ak}$ (expressed in cm) that separates the cathode 2 from the thin anode 4, and of the relativistic factor γ of the electrons at the location of the thin anode 4 in relation with the potential difference applied to the diode 2+3+4. This frequency may be estimated by the following formula:

$$f = \frac{4{,}77}{d_{Ak}}\log\left(\gamma+\sqrt{\gamma^2-1}\right)$$

The microwave wave 7, having axial rotational symmetry, progresses in modes referred to as "transverse magnetic", designated by "$TM_{0n}$", the axial component of its magnetic field being nil. In order for it to propagate inside the cylindrical guide 5 only in mode $TM_{01}$, the radius $R_G$ of the cylindrical wave guide 5 must be greater than the cut-off wavelength of the following mode $TM_{02}$. The equation below (and not the inverse formula which turned out to be erroneous) takes account of these propagation conditions:

$$\frac{k_{01}c}{2\pi f} \leq R_G \leq \frac{k_{02}c}{2\pi f}$$

where $k_{0n}$ represents the root of the equation of the Bessel function $J_0(k_{0n})=0$, with $k_{01}=2{,}4048$ and $k_{02}=5{,}5201$.

The length of the wave guide 5 is, preferably, equal to several times the wavelength λ of the electromagnetic wave 7 (λ=c/f).

The best operation for coupling the virtual cathode 6 with the electromagnetic wave 7 is obtained when the maximum density of the virtual cathode 6 at its average position is situated in the neighborhood of the maximum of the radial component of the electric field of the electromagnetic wave. Considering that the electromagnetic wave 7 propagates in the $TM_{01}$ mode alone and considering also the disintegration of the beam on emission, the radius $R_c$ of the cathode 2 then, preferably, verifies the following relationship:

$$R_c < 1{,}8412\frac{R_G}{k_{01}} \approx 0{,}75 \times R_G$$

The device described above is of simple design. Its operation is robust and does not require recourse to an external magnetic field. However its power efficiency (ratio of maximum power of the emitted wave to the maximum electrical power input into the diode) is very low, of the order of approximately 1%. Furthermore, the frequencies of the emitted wave directly follow the temporal variations in the applied voltage, which leads to an electromagnetic wave being obtained of mediocre spectral quality.

To counter at least some of these drawbacks while maintaining an axial geometry, the implantation of one or more reflectors in the cylindrical wave guide 5 has been proposed.

This type of device was for example the subject of patent application WO2006/037918. An example of a device as described in that application is represented in FIGS. 3 and 4.

The reflectors are typically thin walls (that is to say of the order of the micrometer in thickness), transparent to electrons and configured to reflect totally the microwave wave 7 created by a virtual cathode. Furthermore, they are of circular cylindrical shape, that is to say disk-shaped. They are often formed of aluminized mylar.

In the example represented in FIG. 3, a first reflector 8 is positioned within the wave guide 5 at a distance D1 from the thin anode 4. This distance D1 is equal to substantially twice the distance $d_{Ak}$ that separates the thin anode 4 from the cathode 2, such that a virtual cathode is created and positioned approximately at mid-distance from the thin anode 4 and the first reflector 8.

In this example, an additional reflector 9 is positioned in the wave guide 5 beyond the first reflector 8, such that the distance separating the two successive reflectors is equal to substantially twice the distance $d_{Ak}$ that separates the thin anode 4 from the cathode 2, that is to say substantially the distance D1.

The reflectors may be "closed" or "open". As illustrated by FIGS. 3 and 4, a reflector is said to be "closed" when it entirely closes a cross-section of the cylindrical wave guide 5 (this is the case, for example, for the first reflector 8), and a reflector is said to be "open" when it only obstructs a centered fraction of the cross-section of the cylindrical wave guide 5, leaving a substantially annular opening 10 between the periphery of the reflector and the inside wall of the wave guide 5 (this is the case, in the present example, for the additional reflector 9).

The reflector furthest away from the thin anode 4 is preferably open in order to promote the propagation of the microwave wave towards the exit from the cylindrical wave guide 5, the exit being the opposite end of the cylindrical wave guide 5 from that where the thin anode 4 is situated.

Conventionally, an open reflector presents a radius R greater than or equal to substantially 0.75 times the radius $R_G$ of the cylindrical wave guide 5 to reflect the maximum of the radial component of the electric field of the wave.

The first reflector 8 is operative to reflect the wave emitted by the virtual cathode, like the thin anode 4. The wave reflected by the first reflector 8 again interacts with the electrons and the virtual cathode, amplifying the microwave wave 7. A first pseudo-cavity 11, which is cylindrical, formed between the thin anode 4, the first reflector 8 and an inside wall of the wave guide 5 enables the power of the wave created by the virtual cathode to be strengthened. This strengthening of the wave contributes to improving the bunching of the electrons of the virtual cathode at the desired frequency.

By introducing a plurality of reflectors into the device (that is to say a number N), the mechanism for strengthening the microwave wave 7 and for bunching which takes place in the first pseudo-cavity 11 is duplicated in the following pseudo-cavities formed by two successive reflectors (for example the first reflector 8 and the additional reflector 9 in FIG. 3) and the cylindrical wave guide 5.

Thus the electrons which cross the reflector of rank (i) ($1 \leq i \leq N-1$, where N is the total number of reflectors present) create an $(i+1)^{th}$ virtual cathode of which the oscillation frequency is determined by the pseudo-cavity formed by the reflectors of rank (i) and (i+1) and the inside wall of the wave guide 5. This pseudo-cavity contributes to strengthening the electromagnetic wave 7 emitted by the $(i+1)^{th}$ virtual cathode and the bunching of the electrons.

If the reflector (i+1) is open, the electromagnetic wave emitted by the $(i+1)^{th}$ virtual cathode can flow inside the wave guide 5 beyond the reflector (i+1), towards the exit from the guide, via the annular opening 10 present between the periphery of the reflector (i+1) and the inside wall of the wave guide 5.

This type of device with reflectors enables substantially improved performance to be obtained relative to the devices of the prior art without reflector.

A device, emitting in the S band at the exit from the wave guide, that is to say within a range of frequencies going from 2 GHz to 4 GHz, with a single open reflector exhibits an improvement in efficiency of the order of 4%. The addition of a second open reflector leads to an improvement of the order of 10%.

However, for such a device comprising reflectors, there is an optimum number of reflectors beyond which the power efficiency decreases. For example, a device with three open reflectors exhibits an optimum in efficiency of the order of 13%.

To still further increase the efficiency of a device of VIRCATOR type with reflectors such as described above, the French patent application filed under the Ser. No. 12/62385, and not yet published, describes a microwave wave generator device with a virtual cathode oscillator comprising a plurality of reflectors. All the reflectors are then open with the radius of each of the reflectors of the plurality being less than or equal to the radius of the preceding reflector, the radius of the last reflector being less than the radius of the first reflector. Such a device is for example represented in FIG. 5 according to an example embodiment.

The device of FIG. 5 here comprises a set of five reflectors (N=5), collectively denoted $E_i$ and referenced here $E_1$ to $E_5$, which are located in the wave guide 5, transparent to electrons and configured to reflect the microwave wave created by a virtual cathode. They are for example of aluminized mylar.

All the reflectors $E_i$ are "open" so as to facilitate the propagation of the wave emitted by the different virtual cathodes towards the exit of the wave guide 5.

The radius of the first open reflector $E_1$ located after the thin anode 4 in the wave guide 5 is preferably greater than or equal to 0.75 $R_G$. It thus reflects the maximum of the radial component of the electric field of the wave and thus strengthens the microwave wave emitted by the first virtual cathode that is to say the virtual cathode formed just after the thin anode 4, between the thin anode 4 and the first reflector $E_1$.

The radius of the following reflectors $E_i$ is progressively reduced without lower limit. The size of the radius of each reflector is possibly chosen less than 0.75 $R_G$. The provisions for reducing the size of the radius of the open reflectors are for example the following:

The radius of the reflector of rank (i+1) is less than or equal to the radius of the reflector of rank i, that is to say of the directly preceding reflector.

The radius of the last reflector (here $E_5$, or denoted more generally $E_N$, whatever be N) is less than the radius of the first reflector $E_1$.

In the example embodiment of FIG. 5, the reflectors $E_1$ to $E_4$ have the same radius whereas the last reflector, $E_5$, is of lesser radius.

A device according to the invention described in the French patent application filed under the Ser. No. 12/62385, and not yet published, enables the performance of a conventional axial VIRCATOR of the prior art to be considerably improved, and in particular that of an axial VIRCATOR with reflectors of the prior art as described in the application WO2006/037918. For example, a device with five reflectors of non-uniform radius (with the radius of each reflector less than or equal to that of the immediately preceding reflector), emitting in the S band (that is to say in a frequency range going from 2 GHz to 4 GHz), exhibits an efficiency of 21%.

The operation of the devices of VIRCATOR type of the prior art, described above, is however limited to supply generators of which the immediate Z is less than what is referred to as a "critical" impedance, denoted Z. This critical impedance $Z_c$ is defined as the ratio of the supply voltage V over the critical current $I_c$ defined earlier, that is to say $Z_c=V/I_c$.

FIG. 6 represents a propagation of an electron beam in the wave guide 5 in practically laminar regime when the impedance Z of the generator is greater than the critical impedance Z. This results in no virtual cathode forming. FIG. 7 represents, by way of illustration, the absence of formation of any virtual cathode oscillator in the phase space. No electron can thus be sent back towards the cathode 2 through the thin anode 4.

SUMMARY

The subject-matter of the present invention is directed to mitigating the aforesaid drawbacks at least partly, and furthermore to lead to other advantages.

The subject-matter of the present invention is directed more particularly to enabling a microwave wave generator device with a virtual cathode of axial VIRCATOR type, with reflectors, to be able to operate while being coupled to a generator of which the impedance Z exceeds the critical impedance $Z_c$.

To that end, according to a first aspect, there is provided a microwave wave generator with a virtual cathode oscillator, with axial geometry, comprising a cathode, a thin anode and a cylindrical wave guide, of longitudinal axis z and radius $R_G$, having a first end forming an entrance to the cylindrical wave guide and a second end forming an exit from the cylindrical wave guide, the cathode being positioned upstream of the entry to the cylindrical wave guide and configured to emit electrons, and the thin anode being positioned at the entrance to the cylindrical wave guide, between the cathode and the cylindrical wave guide, and the device further comprising at least a first reflector that is located in the wave guide, transparent to electrons and configured to reflect a microwave wave created by at least one virtual cathode generated in the wave guide, the device being characterized in that it further comprises a narrow magnetic ring of width $L_M$ along the longitudinal axis z, positioned externally around the cylindrical wave guide at a distance $d_{AM}$ from the thin anode and with the first reflector positioned at a distance from the thin anode beyond the magnetic ring such that the magnetic ring is located between the thin anode and the first reflector, the magnetic ring being configured to generate a magnetic field adapted to brake the electrons and to create an accumulation of charge at the origin of a non-oscillating virtual cathode positioned between the thin anode and the first reflector.

By narrow is meant here that the magnetic ring has a width $L_M$ comprised between approximately $d_{AK}$ and approximately half of the radius of the wave guide $R_G$. It is for example equal to approximately $d_{AK}$.

The magnetic ring furthermore has an inside radius $R_M$ which is greater than $R_G$ in order for the magnetic ring to surround the wave guide. The magnetic ring for example surrounds the wave guide at a distance therefrom. However, according to alternative embodiments, the magnetic ring is linked to the wave guide, or is even in contact with it.

Lastly, the magnetic ring has a thickness for example chosen by a user according to the other dimensioning parameters of the device. The magnetic ring is for example a current coil or a permanent magnet such that it is then possible to dispense with electrical supply.

For example, the distance $d_{AM}$ separating the magnetic ring from the thin anode along the axis z is equal to or greater than a distance $d_{AK}$ separating the cathode from the thin anode.

According to another example, the distance $d_{AF1}$ separating the first reflector from the thin anode is equal to or greater than the sum of the distance $d_{AM}$, separating the magnetic ring from the thin anode, and the width $L_M$ of the magnetic ring.

According to still another example, the distance $d_{AF1}$ separating the first reflector from the thin anode is equal to or greater than approximately twice the distance $d_{AK}$ separating the cathode from the thin anode.

Advantageously, at least the first reflector located in the wave guide is an open reflector, that is to say that it obstructs only a centered fraction of cross-section of the cylindrical wave guide, leaving a substantially annular opening between a periphery of the reflector and an inside wall of the wave guide.

According to a particular example embodiment, the first reflector, which is open, possibly has a radius equal to or less than 0.75 $R_G$, the radius of the wave guide.

According to an advantageous embodiment, the device comprises a plurality of successive reflectors positioned in the cylindrical wave guide.

Two successive reflectors of the plurality of reflectors are for example separated from each other by a distance $d_{Fi-1Fi}$ equal to or less than approximately twice a distance $d_{AK}$ separating the cathode from the thin anode.

Or, for example, two successive reflectors of the plurality of reflectors are separated from each other by a distance $d_{Fi-1Fi}$ equal to or greater than approximately once the distance $d_{AK}$ separating the cathode from the thin anode.

Each distance is for example comprised between once and twice the distance $d_{AK}$.

In the context of the present application, whether the device comprises one reflector or a plurality of reflectors, the first reflector is that positioned nearest the thin anode. That is to say, when the device comprises a plurality of reflectors, the first reflector remains that positioned nearest the thin anode, such that the other reflectors of the plurality are positioned downstream of the first reflector.

In an example embodiment in which the device comprises a plurality of successive reflectors, all the reflectors are then advantageously open.

And, for example, the first reflector, which is open, possibly has a radius equal to or less than 0.75 $R_G$, the radius of the wave guide.

Furthermore, when the device comprises a plurality of reflectors, all the reflectors possibly have a same radius $R_{Fi}$.

However, according to an alternative embodiment, each reflector may have a radius equal to or less than that of the directly preceding reflector in the cylindrical wave guide so as to promote guiding of the waves towards the exit of the wave guide. The reflectors thus successively get smaller without lower limit, that is to say that a last reflector in the wave guide, or even a second reflector (that is to say that positioned just after the first reflector) may have a radius less than that of the first reflector.

According to a preferred example embodiment, the device comprises three reflectors positioned in the wave guide.

Such a ring makes it possible to operate a VIRCATOR in axial configuration, with at least one reflector, and a high-impedance generator. The device moreover gains in compactness, since a high-impedance generator is generally less bulky than a low-impedance generator.

The device according to the invention makes it possible to generate a monochromatic microwave emission.

The device according to the invention also makes it possible, at a specific frequency, to emit maximum microwave power along the axis in a single mode.

The device according to the invention makes it possible to adapt a microwave guide in axial configuration with reflectors to the impedance of the generator while maintaining the microwave frequency emitted as well as the geometry of the wave guide.

The device according to the invention enables efficiencies to be attained greater than 15% with high-impedance generators in axial configuration with reflectors.

BRIEF DESCRIPTION OF THE DRAWING

The invention according to an example embodiment will be well understood and its advantages will better appear on reading the following detailed description, given by way of indicative example that is in no way limiting, with reference to the accompanying drawings presented below.

FIG. 10 presents an example of an instantaneous diagram of the position of the electrons in the phase space in the VIRCATOR of FIG. 8;

FIG. 11 diagrammatically presents iso-contours of the intensity of the magnetic field in a longitudinal direction of the VIRCATOR of FIG. 8;

FIG. 12 is a table of the distance between the anode and the first reflector and distances between two successive reflectors for numerical simulations performed on devices according to embodiments of the present invention; and FIG. 13 is a table presenting a power efficiency (in percent) of a device according to embodiments of the present invention as a function of the number of reflectors.

DETAILED DESCRIPTION

Figure 1:
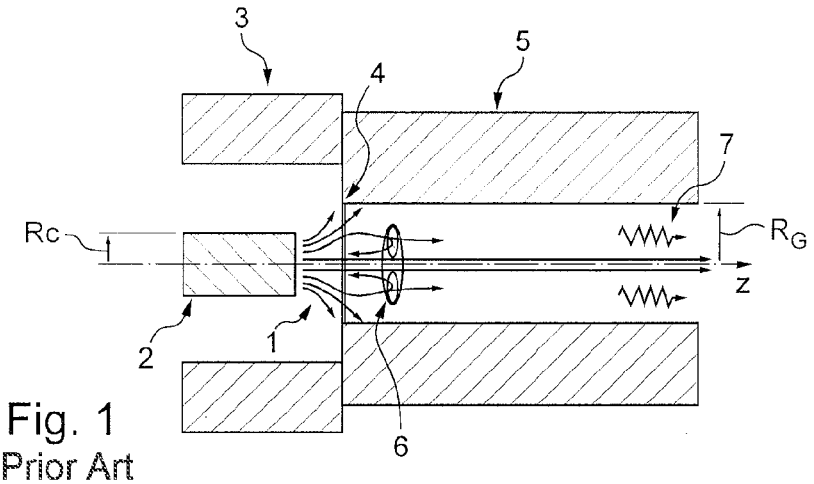
Fig. 1 Prior Art
FIG. 1 diagrammatically represents a conventional axial VIRCATOR of the prior art according to an example embodiment, in longitudinal view, illustrating virtual cathode oscillator creation.
Figure 2:
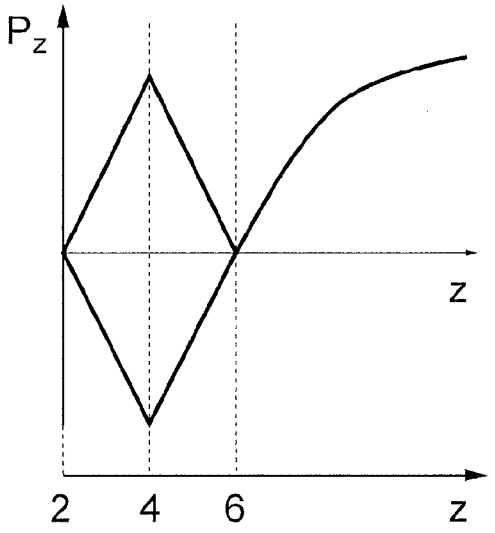
Fig. 2 Prior Art
FIG. 2 presents an example of an instantaneous diagram of the position of the electrons in the phase space associated with the formation of a virtual cathode oscillator.
Figure 3:
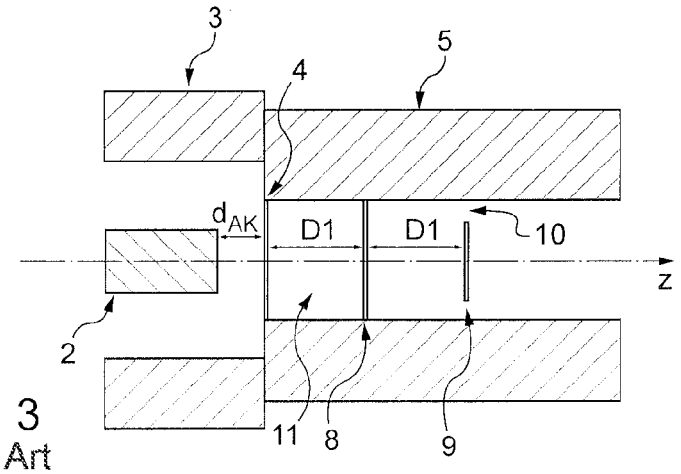
Fig. 3 Prior Art
FIG. 3 diagrammatically represents an axial VIRCATOR with reflectors of the prior art according to an example embodiment as described in document WO2006/037918, in longitudinal view.
Figure 4:
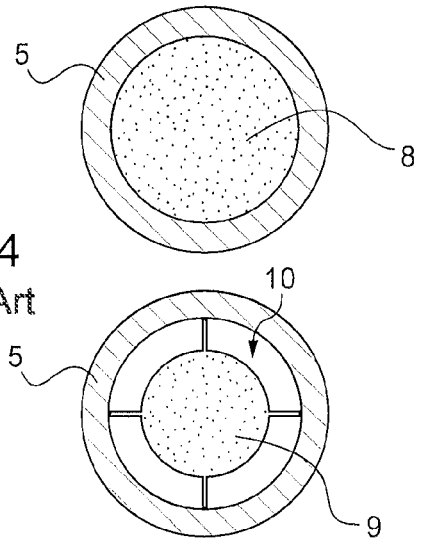
Fig. 4 Prior Art
FIG. 4 represents, in a transverse view of the VIRCATOR of FIG. 3, a closed reflector and an open reflector according to an example embodiment.
Figure 5:
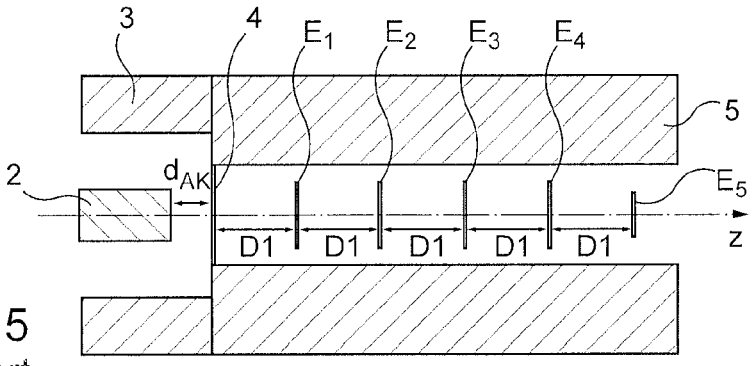
Fig. 5 Prior Art
FIG. 5 represents an axial VIRCATOR example embodiment with open reflectors as described in the application filed under the Ser. No. 12/62385, and not yet published, in a longitudinal view.
Figure 6:
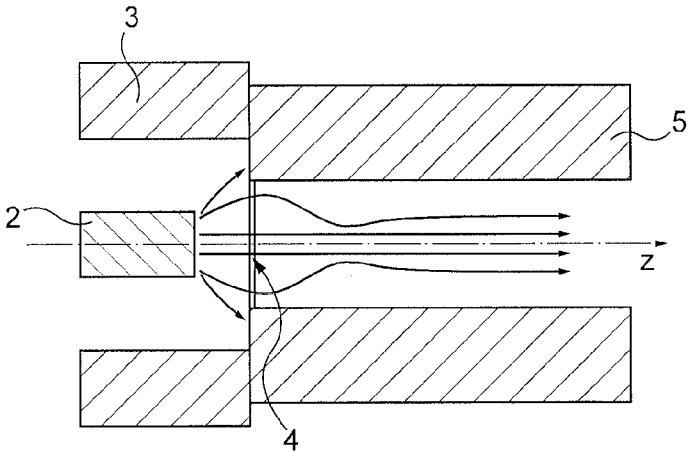
Fig. 6 Prior Art
FIG. 6 diagrammatically illustrates the dynamic of an electron beam in an axial VIRCATOR of the prior art, for example without reflectors, in a longitudinal view, when the supply impedance is greater than the critical impedance, inducing a practically laminar regime and no virtual cathode formation.
Figure 7:
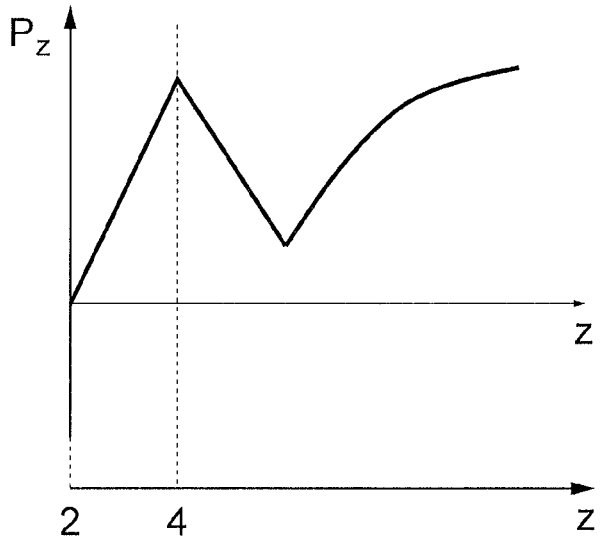
Fig. 7 Prior Art
FIG. 7 presents an example of an instantaneous diagram of the position of the electrons in the phase space in practically laminar regime, in the absence of virtual cathode formation.
Figure 8:
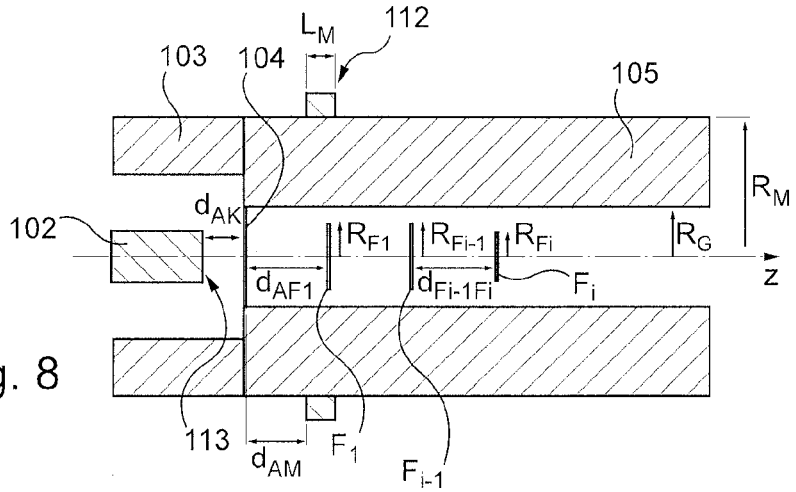
FIG. 8 presents, in longitudinal view, an example embodiment of an axial VIRCATOR with a magnetic ring according to the invention, here comprising open reflectors.
Figure 9:
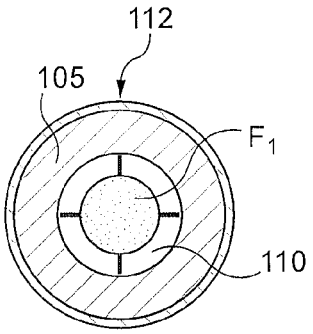
FIG. 9 presents a transverse view of the VIRCATOR of FIG. 8

A device according to an embodiment of the invention is represented for example here in FIG. 8.

As for a conventional device (see in particular FIGS. 1 to 7), the device of FIG. 8 comprises a diode composed of a cathode 102 and an anode, itself formed from a thin sheet called thin anode 104 and from a thick frame 103. The cathode 102 has a radius $R_c$ and the thin anode 104 typically has a thickness of the order of the micrometer, that is to say of a few micrometers or even of a few tenths of micrometers.

The device further comprises a cylindrical wave guide 105 of inside radius $R_G$ and length $L_G$. The cylindrical wave guide 105 comprises an axis z in a longitudinal direction, forming the longitudinal axis of the device.

The thick frame 103 surrounds the cathode 102, and the thick armature 103 and the cathode 102 are positioned at an entrance to the cylindrical wave guide 105 (on the left in the FIG.).

The thin anode 104 is positioned here at an entrance to the cylindrical wave guide 105, between the cylindrical wave guide 105 and the thick frame 103. The thin anode 104 and the cathode 102 are apart from each other by a distance denoted $d_{Ak}$.

The cathode 102, the thin anode 104, the thick frame 103 and the cylindrical wave guide 105 are positioned in relation to each other aligned and centered on the axis z. They generally have circular sections.

To emit microwave radiation on the axis, the radius $R_G$ of the microwave guide 105 is advantageously such that the microwave emission frequency f is greater than the cut-off frequency of the fundamental mode $TE_{11}$ and less than that of the following mode $TM_{01}$:

$$\frac{k'_{11}c}{2\pi f} \leq R_G \leq \frac{k_{01}c}{2\pi f}$$

where $k'_{11}$ represents the root of the equation of the Bessel function $J'_1(K'_{11})=0$ ($k'_{11}=1{,}8412$).

The device according to the invention comprises a magnetic ring 112.

The magnetic ring 112 is advantageously narrow, of width $L_M$ and inside radius $R_M$, greater than $R_G$. In an implementation example in which the ring is a coil, the ring then for example has a thickness which corresponds to a thickness of the conducting wire forming the coil. According to an embodiment that is particularly convenient, the width $L_M$ is approximately equal to $d_{AK}$. Generally, a ring is for example considered to be narrow if $L_M$ is approximately equal to half the radius of the wave guide $R_G$.

It is positioned around the cylindrical wave guide 105, downstream of the anode 104, at a distance $d_{AM}$ from the anode 104 along the axis z. Advantageously, the distance $d_{AM}$ is approximately equal to the distance $d_{AK}$ separating the cathode 102 from the anode 104.

The narrowness (in the longitudinal direction of the cylindrical wave guide 105 represented by the axis z) of the magnetic ring 112 thus provides a magnetic field configuration dominated by the stray fields. In other words, due to the fact that the magnetic ring 112 is narrow, it enables generation of stray fields configured to form a concentration of electrons between the thin anode 104 and a first reflector. The electrons, by winding along the lines of magnetic fields, are focused on the axis z and are, thereby, braked along the axis z. The current of the beam ends up locally exceeding the critical current I. This results in a local accumulation of charges, which is at the origin of the formation of what is referred to as a "non-oscillating" virtual cathode. The virtual cathode here is "non-oscillating" in that only a few electrons are repelled towards the thin anode 104. The magnetic field produced by the ring 112 induces stagnation of the electrons near the axis z.

The magnetic ring 112 is for example a current coil or a permanent magnet such that it is then possible to dispense with electrical supply.

According to a particularly advantageous embodiment of the present invention, the device comprises at least a first reflector $F_1$. The first reflector $F_1$ is situated at a distance $d_{AF1}$ from the thin anode 104 such that $d_{AF1}$ is equal to or greater than the sum of $d_{AM}$ and $L_M$, and preferably equal thereto.

In other words, the ring only extends to the first reflector and not beyond, as in the devices having recourse to a guiding magnetic field. The ring is positioned downstream of the anode, which differs from the devices in which the diode is immersed or semi-immersed for example.

And according to a preferred embodiment, the device comprises a plurality of N reflectors F.

In the present example embodiment illustrated in FIG. 8, the device comprises a set of three reflectors $F_i$ (that is to say with N=3 with the value of i being from 1 to N), which are here all open at their periphery. The reflectors $F_i$ are located downstream of the thin anode 104 and of the magnetic ring 112 in the cylindrical wave guide. The reflectors $F_i$ are transparent to electrons and are adapted to reflect the electromagnetic waves totally. The reflectors are for example formed of aliminized mylar. In operation, all the reflectors are advantageously placed at the same potential as the thin anode 104.

Each reflector has a radius $R_{Fi}$ and two successive reflectors are apart from each other by a distance The positioning of the reflectors $F_i$ in the wave guide 105 is such that the microwave power is maximum on exiting the wave guide 105. Furthermore, the reflectors $F_i$ are for example situated at variable distances from each other, that is to say the distance $d_{AF1}$ and each distance $d_{Fi\text{-}1Fi}$ may be all different from each other. In other words, all the reflectors of the device are fixed in the cylindrical wave guide 105, but the distances separating two successive reflectors may be different from each other and different from the distance $d_{AF1}$ separating the first reflector $F_1$ from the thin anode 104.

Advantageously, the distance $d_{AF1}$ is equal to or greater than twice the distance $d_{AK}$, and each distance $d_{Fi\text{-}1Fi}$ is for example comprised between one to two times the distance $d_{AK}$. As a matter of fact, as the electrons are set in azimuthal rotation in the cylindrical wave guide 105 by the magnetic field of the ring 112, the distance $d_{AF1}$ separating the first reflector $F_1$ from the anode 104 is possibly substantially greater than that of the known devices of VIRCATOR type of the prior art and the distance between the reflectors of ranks i and i+1 is also possibly less than that of the known devices of VIRCATOR type of the prior art.

If the current of the beam is sufficient at the location of a reflector of rank i, a virtual cathode oscillator is initiated behind that reflector, that is to say downstream of the reflector of rank i.

The setting in rotation of the electrons by the magnetic field of the ring 112 in conjunction with the effect of centrifugal force leads to the disintegration of the beam after the last reflector $F_N$ (here $F_3$). A large proportion of the electrons is absorbed by the inside wall of the cylindrical wave guide 105, the electrons remaining are moved away from the center of the cylindrical wave guide 105, that is to say the axis z, which minimizes any possible interaction between the electrons and the magnetic waves at the center of the cylindrical wave guide 105 where the maximum microwave power of the mode $TE_{11}$ is situated.

EXAMPLES

The behavior of an axial VIRCATOR emitting in the S band and comprising N reflectors $F_i$ and a magnetic ring 112 has been numerically simulated.

In the simulated devices, the cylindrical wave guide 105 is here of length $L_G$=500 mm.

They comprise 1 to 3 reflectors, that is to say N=1, 2 or 3, open at their periphery, of uniform radius $R_{Fi}$ less than $R_G$.

The distance between the reflector F1 of the anode and the distances separating each reflector $F_i$ from the preceding reflector, as a function of the number of reflectors $F_i$ disposed in the wave guide are given in the table of FIG. 12.

All the devices considered here make it possible to generate a single-frequency microwave emission in the S band along the axis z in the mode $TE_{11}$.

The generator considered here delivers a voltage of 500 kV.

The critical current $I_c$ beyond which a beam of electrons no longer propagates in the cylindrical wave guide 105 is of the order of 7.4 kA. The "critical" impedance $Z_c$ for this device is thus 67.5Ω (ohm).

The supply generator considered here has an impedance of 70Ω, that is to say greater than the "critical" impedance.

The flow of the beam in the guide is thus practically laminar. The conventional process for formation of the virtual cathode oscillator cannot thus be triggered in an axial VIRCATOR lacking a ring.

The formula which links the frequency emitted to the distance $d_{AK}$ and the applied voltage V indicates that the distance $d_{AK}$ is advantageously chosen between approximately 15.6 mm and approximately 31 mm in order for the microwave electromagnetic radiation to be emitted in the S band. The anode-cathode distance $d_{AK}$ chosen here is approximately 22 mm.

In order for the current emitted by the cathode to be adapted to an impedance of 70Ω with a supply of 500 kV and an anode-cathode distance $d_{AK}$ of approximately 22 mm, the radius of the cathode $R_c$ is then approximately 22.5 mm.

In order for the microwave emission in the S band to be put in the form of the fundamental mode $TE_{11}$ of the cylindrical wave guide 105, the cut-off frequency of the mode, $f_{11}=1.8412c/(2\pi R_G)$, is advantageously less than or equal to 2 GHz. This leads to a radius $R_G$ of the guide greater than approximately 44 mm.

The radius $R_G$ chosen here is thus approximately 50 mm.

The configuration of the magnetic field leads locally to an increase in the current of the beam in the wave guide to exceed the critical current. Under the effect of the stray fields, the electrons are focused on the axis and thereby braked along the axis. This results in a local accumulation of charges at the origin of the formation of a virtual cathode. This virtual cathode is non-oscillating, few electrons are pushed towards the anode, the majority of the electrons are re-accelerated towards the exit from the guide. The magnetic field induces stagnation of the electrons in the neighborhood of the axis.

The magnetic configuration is provided by the magnetic ring positioned here at a distance $d_{AM}$ from the anode of approximately 29 mm.

In the example embodiments considered here, the ring creating the magnetic field is here a current coil of 12750 A.turns (Ampere-turns), with dimensions $L_M$=25 mm and $R_M$=60.5 mm.

The first open reflector of radius $R_{F1}$=35 mm is positioned at the location of the back face of the magnetic ring, at a distance from the anode $d_{AF1}$=54 mm, as indicated by FIG. 12. The first reflector, coupled to the magnetic ring, makes it possible to create the first virtual cathode oscillator behind the first reflector, that is to say downstream of the first reflector.

The positioning of the following reflectors, for the example embodiments comprising two or three reflectors, of radius $R_{F1}$=35 mm, optimizes the microwave power emitted in the S band.

According to FIG. 12, in a configuration with two reflectors, the second reflector $F_2$ is positioned at a distance $d_{F1\text{-}F2}$ of 25 mm from the first reflector $F_1$; and in a configuration with three reflectors, the second reflector $F_2$ is positioned at a distance $d_{F1\text{-}F2}$ of 29 mm from the first reflector $F_1$, and the third reflector is positioned at a distance $d_{F2\text{-}F3}$ of 25 mm from the second reflector $F_2$.

FIG. 11 represents the iso-contours of the intensity of the magnetic field in a longitudinal cross-section of a device according to the invention here comprising one reflector. The maximum intensity of the magnetic field in the guide is of the order of 0.1 T (Tesla) in a cross-section of the wave guide level with magnetic ring 112, that is to say at a cross-section positioned approximately at half the width $L_M$ of the magnetic ring.

FIG. 13 summarizes the performance obtained by simulation of an axial VIRCATOR according to the invention comprising one, two or three reflectors.

FIG. 13 enables it to be noted that the power emitted increases with the number of reflectors. The efficiency attained is of the order of 2.5% with a single reflector and 17.4% with three reflectors. An optimum efficiency is obtained with three reflectors. The addition of a fourth reflector is of little utility for improving the efficiency since the number of electrons decreases and becomes insufficient in the wave guide or near the axis z.

Thus, a device according to the invention supplied by a high-impedance generator makes it possible to emit a microwave power in the S band with an efficiency close to that obtained with a device having axial configuration with reflectors of the known prior art, supplied with a low-impedance generator.

The configuration with three reflectors ensures a minimum efficiency of 13.8% for a distance $d_{F2\text{-}F3}$ between a second reflector and a third reflector comprised between approximately 25 mm and approximately 31 mm, while maintaining the microwave emission frequency.

According to another example, a device according to the invention such as described above, is coupled to a generator with higher impedance, while emitting at the same microwave frequency in mode $TE_{11}$. For example, while maintaining a supply voltage of 500 kV, an increase in the anode-cathode distance $d_{AK}$ to 30 mm induces a reduction in the accelerator field in the diode and thus a lower emitted current, of the order of approximately 4 kA. Therefore, the diode is adapted to a higher supply impedance, for example approximately 125Ω. The density of the emitted beam then being less, slightly increasing the intensity of the current of the magnetic ring to 14250 A.turns makes it possible to generate a single-frequency microwave emission at 2.31 GHz in the mode $TE_{11}$ with an efficiency of 12%. This efficiency may for example be improved by adjusting the positioning of the reflectors in the guide.

Naturally, the present invention is not limited to the preceding description, but extends to any variant within the scope of the following claims.

The invention claimed is:

1. A microwave wave generator device with a virtual cathode oscillator and axial geometry, the device comprising a cathode, a thin anode and a cylindrical wave guide, of longitudinal axis (z) and radius ($R_G$), having a first end forming an entrance to the cylindrical wave guide and a second end forming an exit from the cylindrical wave guide, the cathode upstream of the entry to the cylindrical wave guide and configured to emit electrons, and the thin anode at the entrance to the cylindrical wave guide, between the cathode and the cylindrical wave guide, and further comprising at least a first reflector in the wave guide, transparent to electrons and configured to reflect a microwave wave created by at least one virtual cathode generated in the wave guide, the device further comprising a narrow magnetic ring of width ($L_M$) along the longitudinal axis (z), externally around the cylindrical wave guide at a distance ($d_{AM}$) from the thin anode and with the first reflector at a distance ($d_{AF1}$) from the thin anode beyond the magnetic ring, such that the magnetic ring is between the thin anode and the first reflector, wherein the magnetic ring is configured to generate a magnetic field adapted to brake the electrons and to create an accumulation of charge at the origin of a non-oscillating virtual cathode between the thin anode and the first reflector.

2. The device according to claim 1, wherein the distance ($d_{AM}$) separating the magnetic ring from the thin anode along the longitudinal axis (z) is equal to or greater than a distance ($d_{AK}$) separating the cathode from the thin anode.

3. The device according to claim 1, wherein the distance ($d_{AF1}$) separating the first reflector from the thin anode is equal to or greater than the sum of the distance ($d_{AM}$), separating the magnetic ring from the thin anode, and the width ($L_M$) of the magnetic ring.

4. The device according to claim 1, wherein the distance ($d_{AF1}$) separating the first reflector from the thin anode is equal to or greater than approximately twice the distance ($d_{AK}$) separating the cathode from the thin anode.

5. The device according to claim 1, wherein at least the first reflector, in the wave guide, is an open reflector.

6. The device according to claim 1, further comprising a plurality of successive reflectors in the cylindrical wave guide.

7. The device according to claim 6, wherein two successive reflectors of the plurality of reflectors are separated from each other by a distance ($d_{Fi-1Fi}$) equal to or less than approximately twice a distance ($d_{AK}$) separating the cathode from the thin anode.

8. The device according to claim 6, wherein all the reflectors are open and have a same radius ($R_{Ri}$).

9. The device according to claim 1, wherein the device comprises three reflectors positioned in the wave guide.

* * * * *